US006767154B1

(12) United States Patent
Schwoerer

(10) Patent No.: US 6,767,154 B1
(45) Date of Patent: Jul. 27, 2004

(54) TURNBUCKLE DEVICE

(75) Inventor: Artur Schwoerer, Senden (DE)

(73) Assignee: Peri GmbH (DE)

( * ) Notice: Subject to any disclaimer, the term of this patent is extended or adjusted under 35 U.S.C. 154(b) by 66 days.

(21) Appl. No.: 10/088,267

(22) PCT Filed: Aug. 18, 2000

(86) PCT No.: PCT/DE00/02813

§ 371 (c)(1),
(2), (4) Date: Mar. 13, 2002

(87) PCT Pub. No.: WO01/21910

PCT Pub. Date: Mar. 29, 2001

(30) Foreign Application Priority Data

Sep. 23, 1999 (DE) ..... 199 45 596

(51) Int. Cl.[7] ..... F16D 1/12

(52) U.S. Cl. ..... 403/105; 403/97; 403/101; 403/321; 403/322.1; 403/324; 249/45; 249/47; 249/191; 249/192

(58) Field of Search ..... 403/83, 84, 91, 403/97, 101, 103–106, 321, 322.1, 324, 373, 374.1, 374.2, 374.5; 249/44, 45, 47, 191–193, 195, 219.1

(56) References Cited

U.S. PATENT DOCUMENTS 3,550,898 A * 12/1970 Ursini et al. ..... 249/195

FOREIGN PATENT DOCUMENTS

DE 2908339 C2 2/1984
DE 35 46 832 * 6/1987 ..... E04G/17/04
DE 86 22 358 2/1988
DE 3546832 C2 5/1998
EP 201 887 * 11/1986 ..... E04G/17/04

* cited by examiner

*Primary Examiner*—Gregory J. Binda
*Assistant Examiner*—Michael P. Ferguson
(74) *Attorney, Agent, or Firm*—Walter A. Hackler

(57) ABSTRACT

A turnbuckle device (10) for clamping concrete shell elements (35, 36) comprises stationary claws (14, 15) and pivotable claws (24, 25) which can be clamped with the stationary claws (14, 15) via a wedge (28) on two neighboring concrete shell elements (35, 36) in that the claws (14, 15, 24, 25) engage in profilings on the frame of the concrete shell elements (35, 36). The stationary claws (14, 15) have archings (18) which engage behind transverse struts (34) or longitudinal struts (33) of a concrete shell element (36). The turnbuckle device (10) is displaceably held on the concrete shell element (36) via the archings (18). If the claws (14, 15, 24, 25) are within the concrete shell element (36), the turnbuckle device (10) can be displaced on the concrete shell element (36) in a longitudinal direction of the transverse strut (34 ) only that far that the turnbuckle device (10) does not project over an outer edge (39) of the concrete shell element (36). The archings (18) and the position of the claws (14, 15, 24, 25) ensure that the turnbuckle device (10) is also safely fixed on the concrete shell element (36) if it is removed. The wedge (28) is a clamping means for the turnbuckle device (10) and also an opening and closing means for the pivotable claws (24, 25).

7 Claims, 8 Drawing Sheets

TURNBUCKLE DEVICE

The invention concerns a turnbuckle device for mutually clamping two concrete shell elements comprising a frame with longitudinal struts and transverse struts, across a joint covered by the turnbuckle device formed with claws, wherein the turnbuckle device comprises one or more retaining means for retention on longitudinal or transverse struts of a concrete shell element, by which the turnbuckle device can be mounted on the concrete shell element in a way it cannot fall off self-actingly, preferably also in a position in which the turnbuckle device is positioned within an outer edge of the concrete shell element, and wherein at least one arresting means is provided, wherein the turnbuckle device can be brought into a tensioning position on the concrete shell element when the arresting means is released or removed.

BACKGROUND

Turnbuckle devices of this type are known e.g. from the document U.S. Pat. No. 3,550,898.

The turnbuckle device disclosed in DE 35 46 832 C2 for mutually clamping two concrete shell elements comprising a frame and a shell cover mounted thereto, along a joint covered by the turnbuckle device, has two principally "L"-shaped claws which are disposed next to each other. One kind of the legs of the claws engage behind one abutment surface each of each shell element. The other kind of legs of the claws extend next to each other on the surface of the frame legs facing away from the shell cover. A clamping means engages on these legs. The surfaces of the longitudinal struts facing away from the shell cover abut on said leg of said claw. The other claw is pivotable about an imaginary axis which extends parallel to the joint between the two shell elements to be clamped with respect to each other, and to the shell plane and can be displaced with respect to the one claw at a right angle to the shell plane.

DE29 08 339 C2 discloses a wedging for shell panels for concrete walls, wherein the wedge slide has a substantially U-shaped cross-section comprising legs with inwardly protruding projections which form, with the laterally projecting parts on the transverse strut, a wedging. The transverse strut is lower by the thickness of the yoke part of the wedge slide than the longitudinal struts. A support is provided in the region of the connecting rod on the transverse strut whose height corresponds to this size such that the wedge slide can be retained in the position in which it does not project over the area of the frame.

U.S. Pat. No. 3,550,989 discloses a turnbuckle device for mutually clamping two concrete shell elements which comprise a frame with transverse struts. The turnbuckle device comprises a first and a second lock part, wherein the first lock part can be axially displaced relative to the second lock part. The two lock parts can be pivoted in total about a bolt. The claw of the first lock part is retained on a first concrete shell element via a bolt, whereas the claw of the second lock part can engage a bolt of a second concrete shell element. For arresting the turnbuckle device, an arresting means is provided which can limit the pivoting range of the entire turnbuckle device when the claw of the second lock part abuts the bolt of the second concrete shell element. The arresting means permits mutual clamping of the lock parts.

It is the underlying purpose of the invention to produce a turnbuckle device which on the one hand can be mounted to any point of the transverse struts and/or longitudinal struts of a concrete shell element and on the other hand can remain at the mounted point for removing a concrete shell element and, in use, can compensate for a level difference between two concrete shell elements.

SUMMARY OF THE INVENTION

This object is achieved in accordance with the invention in that the turnbuckle device comprises a second lock part which can be pivoted relative to the first lock part, wherein the first lock part comprises a stationary first claw and the second lock part comprises a second claw, with both claws being adjusted to be suitable for direct engagement on the frame, wherein the arresting means limits the pivoting range of the second lock part such that the second claw prevents release of the turnbuckle device from the concrete shell element and optionally limits or prevents movability of the turnbuckle device on the frame section.

The inventive turnbuckle device permits on the one hand to mutually clamp concrete shell elements in a conventional fashion, and, on the other hand, the turnbuckle device can be left on one of the concrete shell elements when the concrete shell elements are to be moved at a building site. Towards this end, the inventive device is moved and positionally fixed in a region in which it no longer protrudes over the edge of a concrete shell element. No additional means are required to displace and fix the inventive turnbuckle device. Merely the clamping connection known to the skilled worker must be released with conventional means. When the clamping connection is released, part of the inventive turnbuckle device can be pivoted and be displaced until it is located within a concrete shell element. In this position, the pivotable part of the inventive turnbuckle device can be pivoted back into a closed position in which a stationary part of the inventive turnbuckle device is oriented corresponding to the pivotable part along a transverse or longitudinal strut. The pivotable part can be blocked by the clamping means, e.g. a wedge. Retaining means retain the stationary part of the inventive turnbuckle device at the concrete shell element to exclude accidental drop or detachment of the inventive turnbuckle device when moving a concrete shell element, e.g. with a crane.

The inventive turnbuckle device allows the construction of large shell surfaces in less time and in a simpler way. When the inventive turnbuckle device is unlocked and mounted to the concrete shell element via retaining means, it can be displaced with one hand in a controlled fashion without being removed from the concrete shell element, and the clamping means can be activated or released with the other hand, if required. The skilled worker does not have to hold the weight of the inventive turnbuckle device since it is guided and displaceably supported on the transverse or longitudinal strut. This facilitates the handling of the inventive turnbuckle device and the effort required for alignment, release or clamping of the turnbuckle device.

Recesses can be provided along the longitudinal or transverse struts of the concrete shell elements behind which the one or more retaining means can engage, wherein the recesses are formed in the surface and/or the side faces of the longitudinal and/or transverse struts.

This is advantageous in that the inventive turnbuckle device can be displaceably mounted on the concrete shell element with simple means that cannot fall off self-actingly. The recesses can extend over the entire length of the frame legs or the transverse struts. This design permits displacement of the inventive turnbuckle devices within a wide region on the concrete shell element without a need for dispensing with a secure holding of the turnbuckle device on the concrete shell element. The turnbuckle device can be safely mounted with retaining means, such as archings or bolts on the concrete shell element via openings or simple profilings or grooves on the longitudinal or transverse struts.

In an advantageous fashion, the turnbuckle device can be removed from the concrete shell element when the arresting means is released or removed.

A particular holder with the most simple means which safely holds and guides the inventive turnbuckle device is provided when the retaining means are archings which protrude locally from the inner surface of the stationary claws and engage in lateral recesses of the longitudinal or transverse strut. Such archings can be produced without additional material by pressing out of the claw material, or bolt-like projections are mounted at appropriate points on the inner surfaces of the claws. If the opposite archings, bolts, etc. are mutually offset, a separation, i.e. a free length between the archings can be produced via pivoting of the inventive turnbuckle device in the released state, said free length in the pivoted state of the turnbuckle device being larger, with respect to a transverse strut or longitudinal strut, than the width of a longitudinal strut or a transverse strut, and therefore no longer engage in the pivoted state of the longitudinal strut or transverse strut. In this state, pivoted with respect to the axial orientation of the transverse strut or the longitudinal strut, the inventive turnbuckle device can be removed from the transverse strut or from the longitudinal strut. If the turnbuckle device is disposed on the longitudinal strut or the transverse strut and the archings of the turnbuckle device engage behind the transverse strut or the longitudinal strut, the archings are disposed such that they are guided with play in the recesses of the longitudinal strut or the transverse strut. This facilitates displacement of the turnbuckle device along a longitudinal strut or a transverse strut.

In a further embodiment of the invention, the archings can be formed opposite to each other, and the end regions of the longitudinal struts or transverse struts each comprise recesses with limited length in the edge region in the surface of the longitudinal struts and/or transverse struts, and the size (length, width, height) of the recesses are matched to the position of the archings such that the turnbuckle device is held within a concrete shell element when the second claw is in the pivoted inner position state. If the archings are directly opposite to each other, the turnbuckle device must be mounted into a recess, e.g. a groove, of a longitudinal strut or a transverse strut by opening the turnbuckle device that wide that the pivotable claws do not obstruct mounting of the turnbuckle device. The size and shape of the stationary and pivotable claws permit matching of the size of the recesses to the turnbuckle device such that in the pivoted inner position state of the turnbuckle device, the turnbuckle device cannot inadvertently slide through the recesses out of the transverse strut or longitudinal strut and drop off from the concrete shell element.

In a further embodiment of the inventive turnbuckle device, the retaining means is formed by a shackle which projects from a rod-shaped body which holds the first lock part and movably guides it on the concrete shell element. The turnbuckle device is detachably held on the concrete shell element via a mounting means, e.g. a bolt, in that the bolt is put through a first opening in the shackle and at the same time through a second opening in the longitudinal strut or in the transverse strut. The turnbuckle device can be displaced along the rod-shaped body in the unlocked state, and a pivoting motion of part of the inventive turnbuckle device with respect to the stationary part of the turnbuckle device is not impaired by the rod-shaped body. The bolt can also be formed on the shackle in accordance with the invention. The bolt can engage in openings on the concrete shell element and may be secured, if required.

The inventive turnbuckle device can be pivoted via engagement of the bolt on the concrete shell element, if required, wherein the bolt forms the axis of rotation. In such an embodiment, the pivoting range of the movable claw can be reduced and the advantages with regard to handling and safety of the inventive turnbuckle device can still be achieved without any limitations.

In a further embodiment of the invention, the retaining means is formed by a pivoting and/or tilting lever which is provided on the stationary claws or in the region of the stationary claws, wherein the pivoting and/or tilting lever engages behind surfaces of the longitudinal or transverse struts, when connected to a longitudinal or transverse strut.

This is advantageous in that such retaining means can be mounted to any recesses of a longitudinal or transverse strut. The pivoting and/or tilting levers can be disposed on a claw itself or directly behind a stationary claw. The pivoting and/or tilting levers can be fixed in position either through spring elements or latches to provide secure retention of an inventive turnbuckle device on a concrete shell element. In order to suspend the connection to a longitudinal or transverse strut, latching of the pivoting and/or tilting levers must be released or a spring-loaded pivoting or tilting lever must be released from the spring load. Such a retaining means provides a simple and quick to handle connecting system for a turnbuckle device to be detachably mounted to a concrete shell element.

In a particularly advantageous manner, the arresting means is a wedge which blocks the pivotable claw in the pivoted inner position state or clamps the turnbuckle device for mutually clamping two concrete shell elements when the wedge is displaced in the direction of the acting force of gravity on horizontally oriented struts. If the wedge is displaced against the force of gravity, the second claw can be pivoted into an open position and a displacing position. In the open position, the pivotable claw can be pushed towards the stationary claw until both claws, the stationary and the pivotable claw, can abut within one concrete shell element. The claws can be mutually fixed via the arresting means, e.g. a wedge, thereby preventing that the turnbuckle device twists with respect to the transverse strut or longitudinal strut or is displaced into a position in which the turnbuckle device could project over the edge of a concrete shell element.

If the inventive turnbuckle device is mounted to vertically oriented struts, the arresting means, e.g. a wedge, must be displaced such that it exerts the same function as in the above description.

Further advantages can be extracted from the description and the enclosed drawing.

BRIEF DESCRIPTION OF THE DRAWINGS

The features mentioned above and below can be used in accordance with the invention either individually or collectively in any arbitrary combination. The embodiments mentioned are not to be understood as exhaustive enumeration but rather have exemplary character. The invention is shown in the drawing.

DETAILED DESCRIPTION

Figure 1:
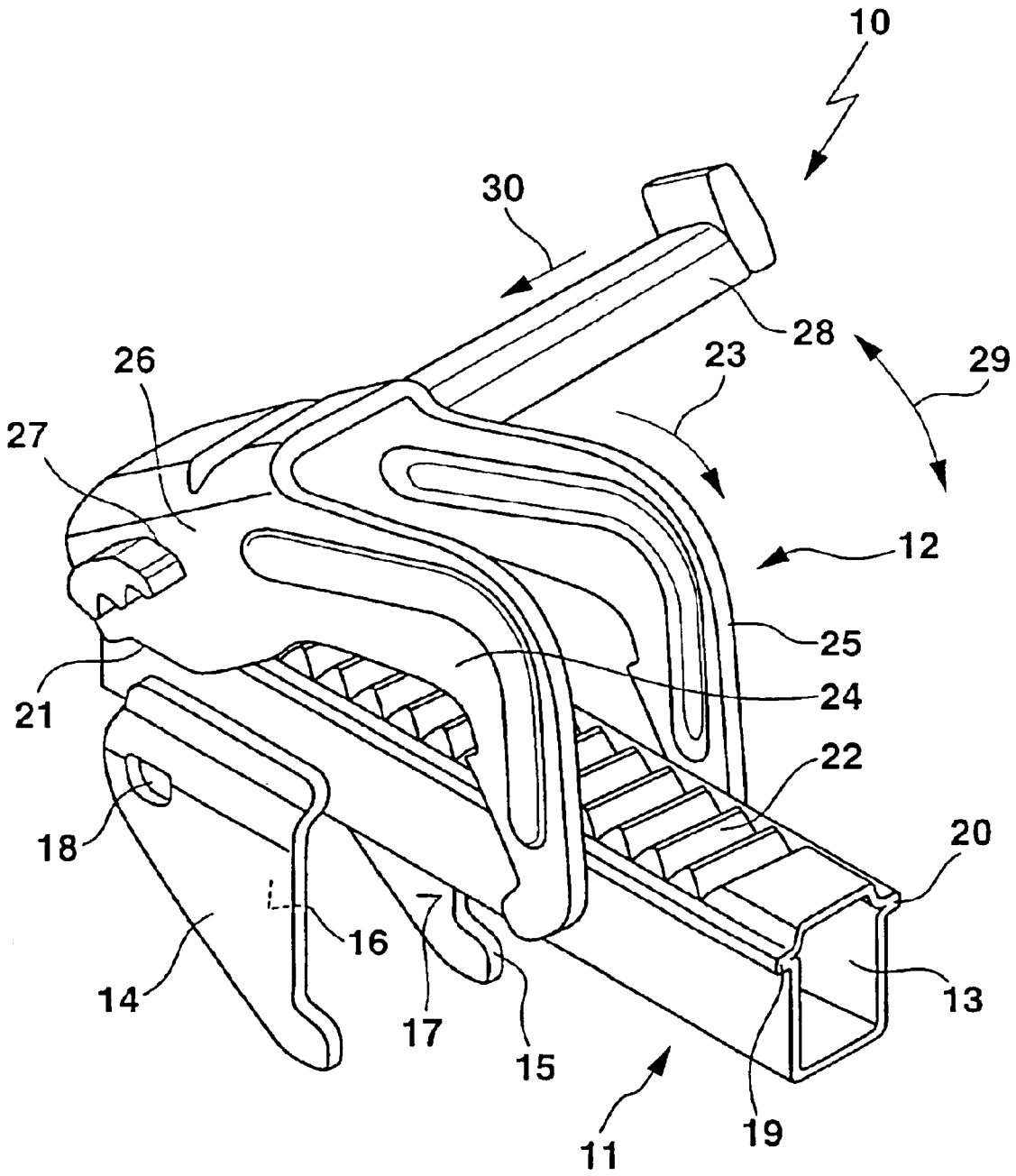
FIG. 1 shows an inventive turnbuckle device in the open position without concrete shell element.

FIG. 1 shows a turnbuckle device 10 composed of a first lock part 11 and a second lock part 12. The first lock part 11 is formed essentially of a square profiled pipe 13, with stationary fist claws 14, 15 mounted laterally at one end of the square profiled pipe 13. Archings 18 are formed on inner surfaces 16, 17 of the first claws 14, 15, which project over the inner surfaces 16, 17. FIG. 1 shows only one arching 18, the other arching 18 on the inner surface 17 of the stationary first claw 15 is covered by the square profiled pipe 13. The archings 18 are spaced apart from the lower side of the square profiled pipe 13.

The sides of the square profiled pipe 13 have guiding strips 19, 20 which are formed over the entire length of the square profiled pipe 13 behind which engage projections 21 of the second lock part 12 such that in the position of the second lock part 12 shown, the second lock part 12 can be displaced and pivoted like a slide with regard to the first lock part 11 along the square profiled pipe 13. The upper side of the square profiled pipe 13 is provided with a row of teeth 22 which cooperates with at least one tooth of a retaining means when pivoting the second lock part 12 in the direction of the arrow 23, with the retaining means projecting from the inner side of the second lock part 12. The at least one tooth projects in the direction of the row of teeth 22.

The second lock part 12 comprises pivotable second claws 24, 25 which are spaced apart from each other and laterally engage over the square profiled pipe 13 in the pivoted inner position state. The pivotable second claws 24, 25 terminate in a leg region 26 which connects the two second claws 24, 25 and also provides an opening 27 for a wedge 28 with a toothing on one side which can cooperate with the row of teeth 22. FIG. 1 shows this wedge 28 in a first end position. In this first end position, the second lock, part 12 can be pivoted in the directions of the arrow 29. In the open state of the turnbuckle device 10, shown in FIG. 1, the second lock part 12 can be displaced also along the square profiled pipe 13, if required.

If the second lock part 12 is pivoted in the direction of the arrow 23 towards the row of teeth 22 until a tooth of the retaining means of the second lock part 12 engages in the row of teeth 22, the wedge 28 can be displaced in the direction of the arrow 30 towards a second end position and the pivoting motion of the second lock part 12 with respect to the first lock part 11 is blocked.

Figure 2:
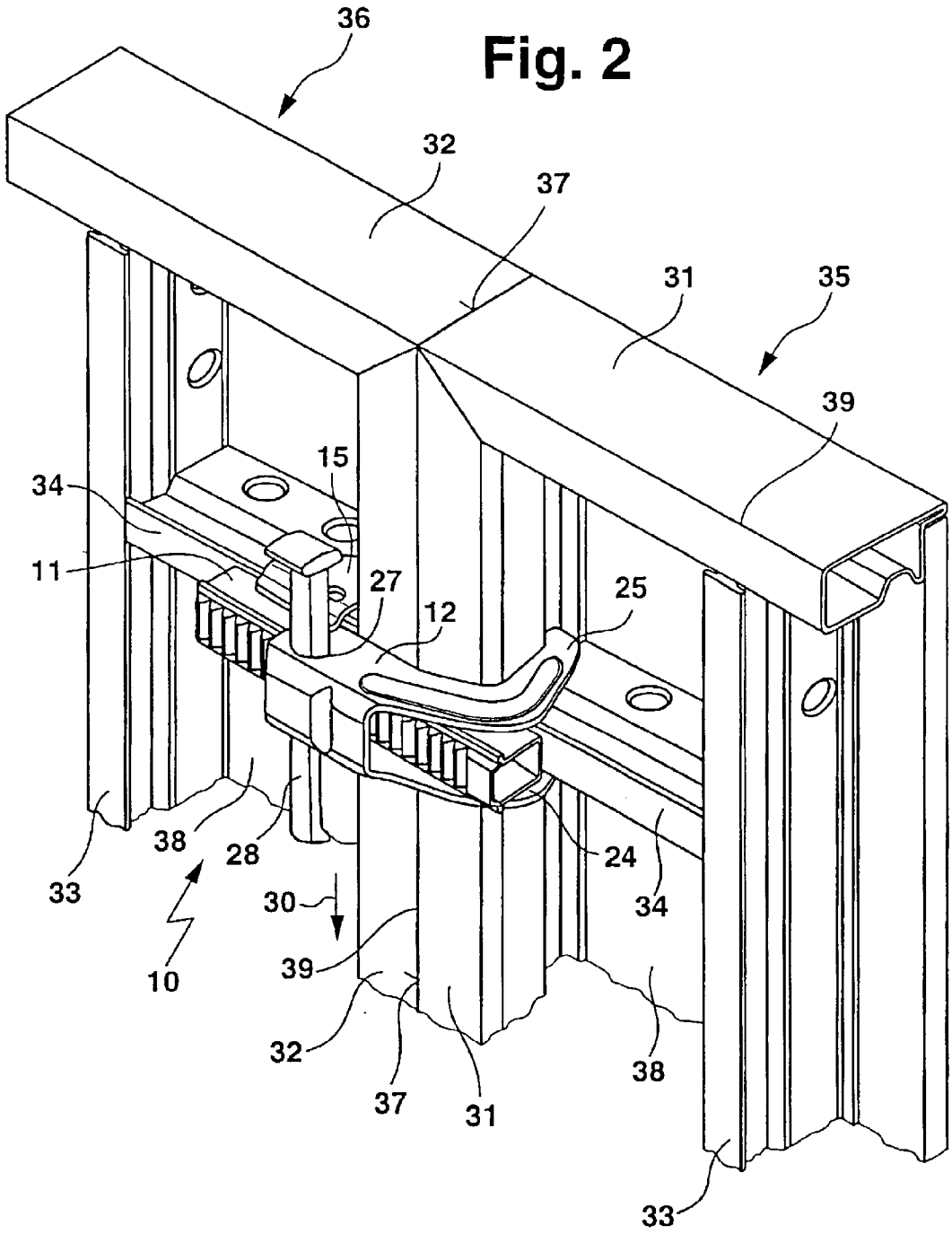
FIG. 2 shows an inventive turnbuckle device clamped on two concrete shell elements, in which claw profilings engage the frame of the concrete shell elements and are tensioned via a tensioning means, e.g. a wedge.

FIG. 2 shows the turnbuckle device 10 of FIG. 1 mounted on frames 31, 32 with concrete shell elements 35, 36 comprising longitudinal struts 33 and transverse struts 34. The turnbuckle device 10 mutually clamps the concrete shell elements 35, 36 overlapping a joint 37. The concrete shell elements 35, 36 are usually formed of the frames 31, 32 holding a shell cover 38 on the one side and comprising the longitudinal struts 33 and transverse struts 34 on the other side for stiffening the concrete shell elements 35, 36.

The stationary first claws 14, 15 and pivotable second claws 24, 25 of the turnbuckle device 10 engage in profilings of the frame 31, 32. The stationary claw 14 shown in FIG. 1 is covered by the turnbuckle device 10 in FIG. 2. The wedge 28 is displaced in the direction of the arrow 30 of the acting force of gravity and further driving of the wedge 28 into the opening 27 of the second lock part 12 produces approximation between the stationary first claws 14, 15 of the first lock part 11 and the pivotable second claws 24, 25, thereby increasing the clamping action between the concrete shell elements 35, 36.

When the concrete shell elements 35, 36 are clamped, the turnbuckle device 10 overlaps the edges 39 of the respective frames 31, 32.

Figure 3:
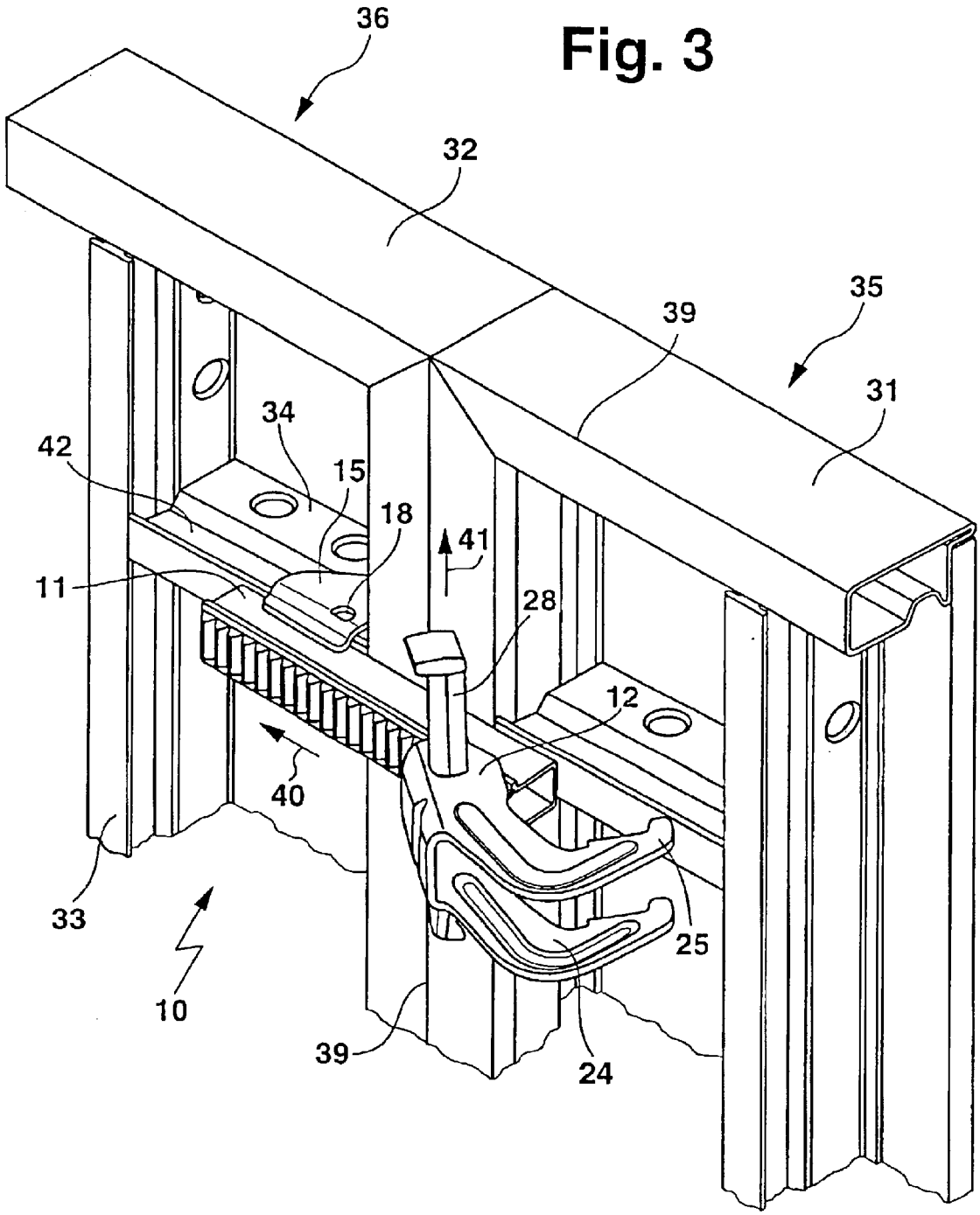
FIG. 3 shows an inventive turnbuckle device in the open state, in which a stationary claw engages behind a frame and a pivotable claw is in an open position which is located outside of a frame, a transverse strut and a longitudinal strut.

FIG. 3 shows the turnbuckle device 10 in an open state, i.e. the second lock part 12 is pivoted and moved with respect to the first lock part 11 such that the pivotable second claws 24, 25 no longer engage in a profiling of the frame 31 of the concrete shell element 35. The free claw ends of the pivotable second claws 24, 25 are pivoted such that they terminate at a separation above the edge 39, i.e. the second lock part 12 can be displaced in the direction of the arrow 40 along the square profiled pipe 13 until it is no longer in the region of the concrete shell element 35.

To pivot the second lock part 12 as shown in the figure, the wedge 28 must be displaced into a final position (first end position) in the direction of the arrow 41.

The first lock part 11 can be displaced along the transverse strut 34 until the claw 15 abuts the longitudinal strut 33. The free spaces in the frames 31, 32 are matched such that the turnbuckle device 10 can be displaced along the transverse strut 34 until the free ends of the pivotable second claws 24, 25 no longer project over the edge 39. The second lock part 12 can be positionally fixed with regard to the first lock part 11 by displacing the wedge 28 against the direction of the arrow 41.

The transverse strut 34 is engaged behind with play via the archings 18 of the stationary first claws 14, 15 such that the turnbuckle device 10 is safely held on the frame 31 via the archings 18. The archings 18 thereby engage in recesses 42 of the transverse struts 34. The recesses 42 can be formed by grooves which are formed on both sides along the transverse strut 34.

The turnbuckle devices shown in the figures can also be disposed on longitudinal struts. Then, the function of the turnbuckle device does not differ from the turnbuckle device on a transverse strut.

Figure 4:
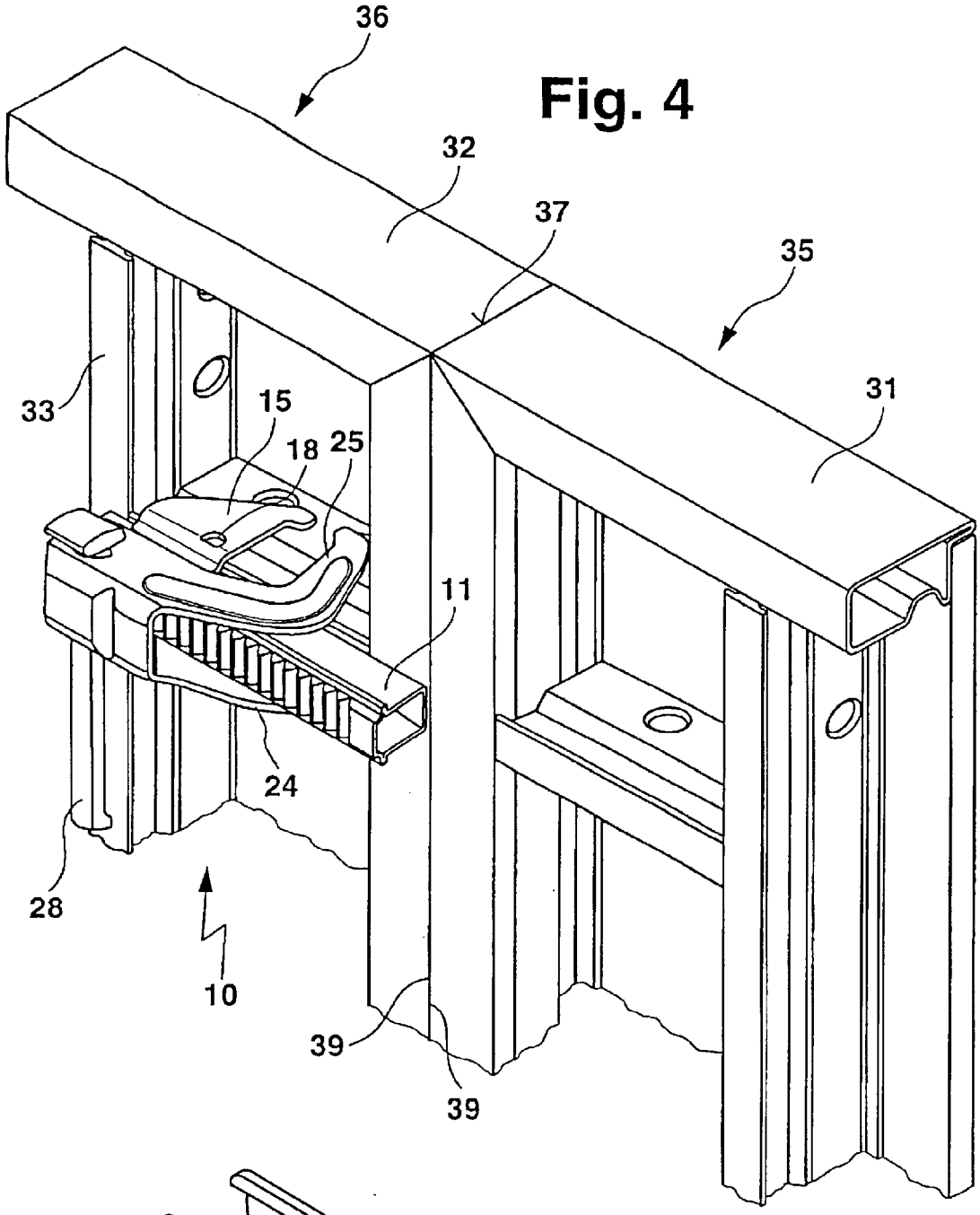
FIG. 4 shows an inventive turnbuckle device in the pivoted inner position state as fixed within a concrete shell element without projecting over the outer edge of the concrete shell element.

FIG. 4 shows an arrangement of the turnbuckle device 10 disposed completely within the frame 32 of the concrete shell element 36 (closing or retaining position). The first lock part 11 and the second lock part 12 are moved towards one another such that they abut within a free space between the longitudinal strut 33 and the frame 32. The pivotable second claws 24, 25 are completely pivoted into the inner position with regard to the first lock part 11, and the wedge 28 is displaced into a final position in which it blocks pivoting of the second claws 24, 25. In the position of the turnbuckle device 10 shown in FIG. 4, the concrete shell element 35 can be removed from the concrete shell element 36. The turnbuckle device 10 is moved into the concrete shell element 36 that far that it abuts next to the joint 37 formed by the edges 39 of the two concrete shell elements 35, 36.

In the position of the turnbuckle device 10 shown in FIG. 4, the concrete shell elements 35, 36 can be arbitrarily displaced. If the concrete shell elements 35, 36 (all the figures show only partial sections thereof) are to be connected to each other again, the concrete shell elements 35, 36 must be displaced towards each other until they abut each other, and the turnbuckle device 10 must be unlocked in that the wedge 28 is displaced from the end position shown in FIG. 4 to the top that far that the pivotable second claws 24, 25 can be pivoted until they can overlap the frame 32 and 31. The pivotable second claws 24, 25 are pivoted again into a profiling of the frame 31, and the spline toothing is activated via the wedge 28 in that the wedge 28 is driven from an upper end position (first end position) in the direction of the position shown in FIG. 4. The further the wedge 28 is driven into the second lock part 12, the stronger the concrete shell elements 35, 36 are pulled towards each other.

Figure 5:
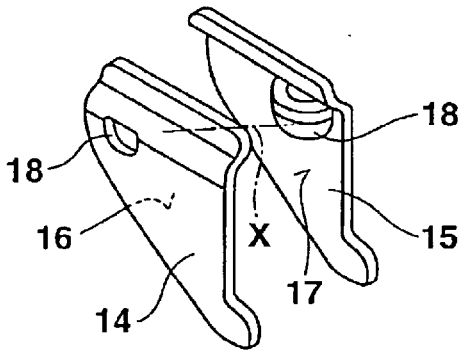
FIG. 5 shows an arrangement of archings at stationary claws of an inventive turnbuckle device.

FIG. 5 shows an embodiment of the arrangement of archings 18 as formed on the turnbuckle device 10, namely the lock part 11. The archings 18 on the inner surfaces 16, 17 are mutually displaced such that a separation x is larger than the width of the longitudinal strut or the transverse strut.

Figure 6:
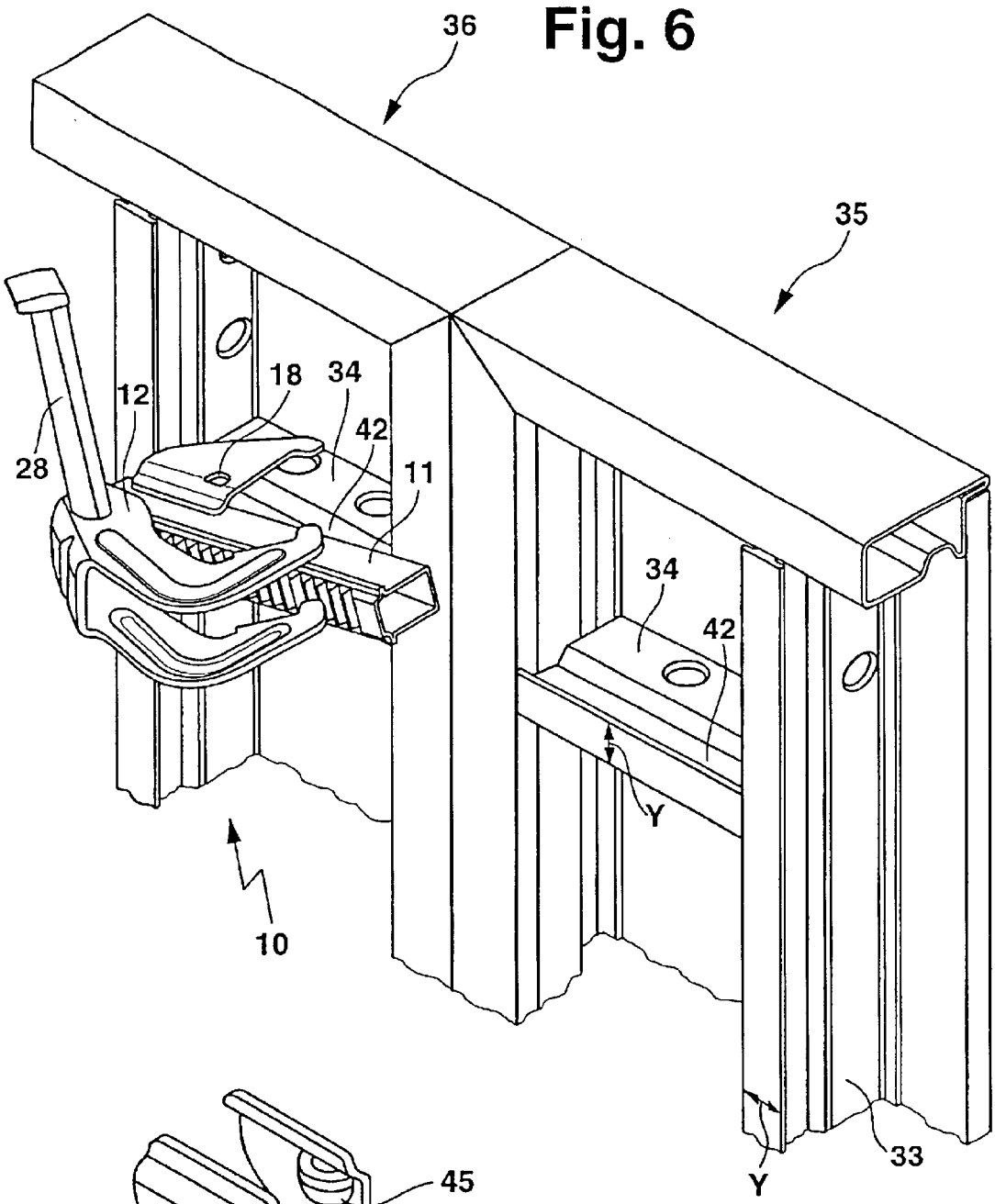
FIG. 6 shows an inventive turnbuckle device pivoted to a transverse strut, wherein the archings no longer engage behind the transverse strut.

FIG. 6 shows the turnbuckle device 10 as it can be removed from the concrete shell element 36. The turnbuckle device 10 must be unlocked compared to FIG. 4, i.e. the wedge 28 must be displaced into an upper end position (first end position) to permit pivoting of the lock part 12 away from the overlap by laterally overlapping the transverse strut 34. The lock part 11 which is held over the archings 18 in the recesses 42 of the transverse strut 34 must be pivoted at an inclination to the transverse strut 34 until the separation x, the direct connection line between the offset, opposite archings 18, liberate a separation x which is larger than the width y of the transverse strut 34 or of the longitudinal strut 33. If the turnbuckle device is oriented parallel to the transverse strut 34 or to the longitudinal strut 33, the archings 18 engage behind the transverse strut 34 or the longitudinal strut 33 producing a width which is smaller than the width of the transverse strut 34 or the longitudinal strut 33. If the turnbuckle device 10 has an inclination as shown in FIG. 6, the entire turnbuckle device 10, i.e. the first lock part 11 and the second lock part 12 can be removed together from the transverse strut 34.

Figure 7:
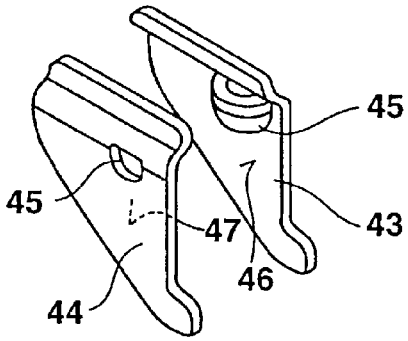
FIG. 7 shows a further embodiment of archings on stationary claws.

FIG. 7 shows a further embodiment of the stationary first claws 43, 44 with opposite archings 45. The archings 45 shown in FIG. 7 project over the inner surfaces 46, 47. The stationary first claws 43, 44 formed in this fashion, can be mounted on the first lock part. When stationary first claws 43, 44 are used, transverse struts and longitudinal struts are to be selected as shown in FIG. 8.

Figure 8:
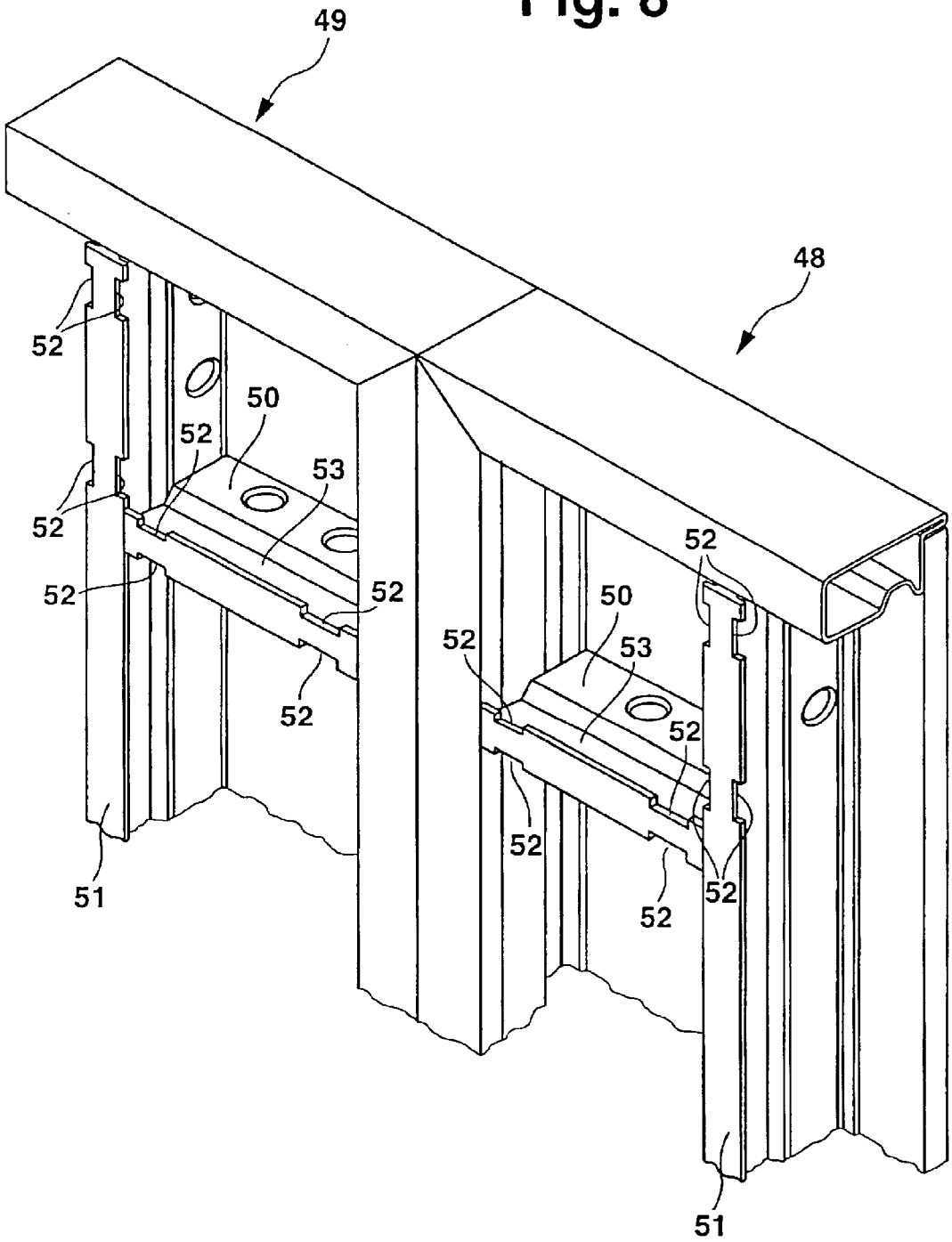
FIG. 8 shows embodiments of longitudinal struts and transverse struts for a further embodiment of an inventive turnbuckle device.

FIG. 8 shows a further development of transverse struts and longitudinal struts as they are formed on the concrete shell elements 48, 49. The concrete shell elements 48, 49 comprise transverse struts 50 and longitudinal struts 51 whose surfaces are provided with recesses 52. A turnbuckle device 10 comprising archings 45 as shown in FIG. 7 can be mounted into the respective transverse strut 50 or longitudinal strut 51 via a pair of opposite recesses 52, when the turnbuckle device 10 is open, i.e. the pivotable claws are pivoted into an open position that far that the stationary claws can be moved into a recess 53, e.g. a groove, via the recesses 52. If a turnbuckle device is displaced along a transverse strut 50 or a longitudinal strut 51 such that the pivotable claws can be pivoted into an inner position and are pivoted into the inner position and fixed by the wedge, the claw widths and the sizes of the recesses 52 are matched such that the turnbuckle device cannot fall off or be withdrawn self-actingly from a transverse strut 50 or a longitudinal strut 51. The turnbuckle device having archings 45 of FIG. 7 can be removed from the transverse strut 50 or the longitudinal strut 51 only when the turnbuckle device is opened, i.e. the pivotable claws are to be pivoted into an open position by moving the wedge in an upper end position (first end position).

Figure 9:
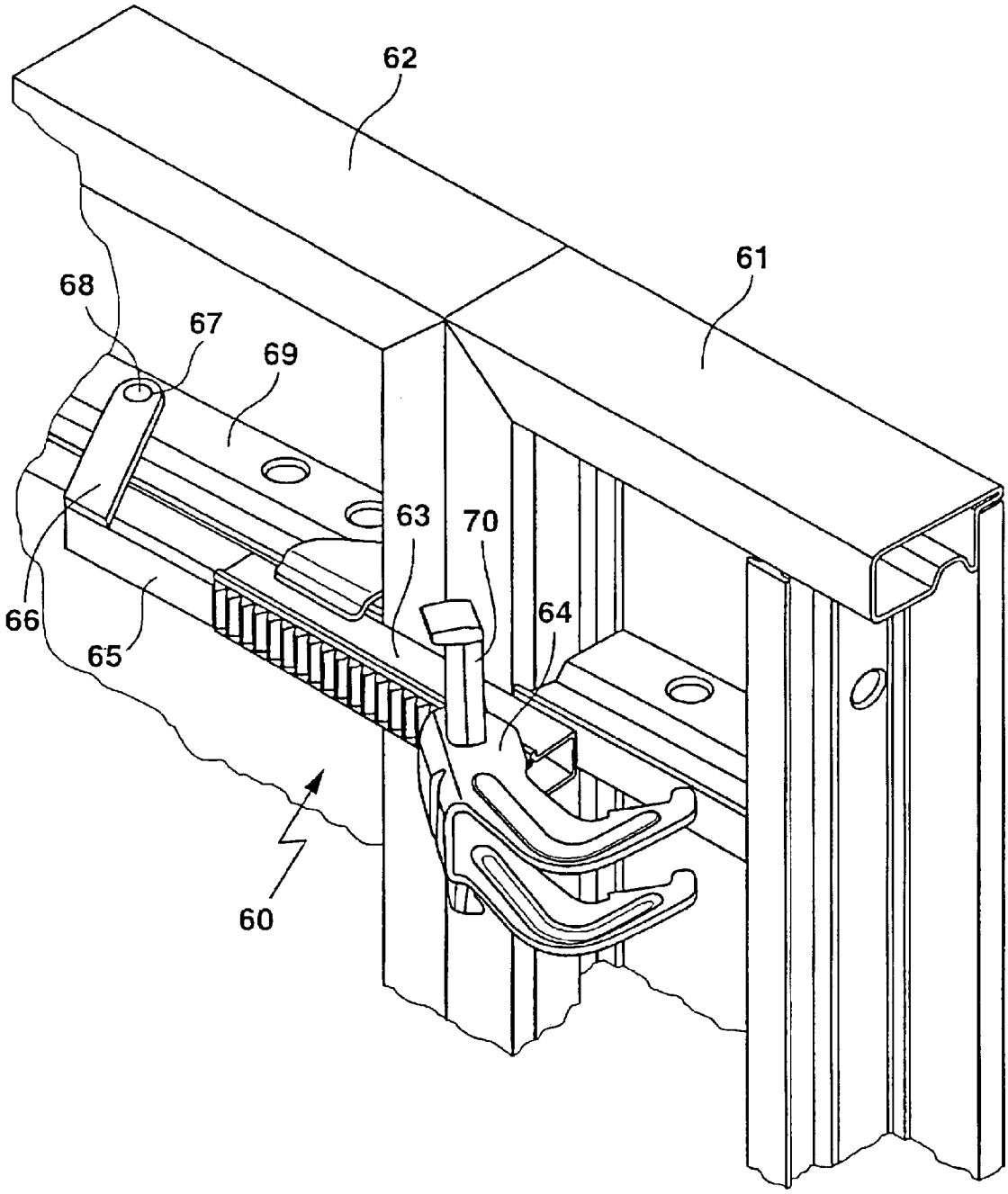
FIG. 9 shows a further possibility (holding means) for holding an inventive turnbuckle device on a transverse strut.

FIG. 9 shows a turnbuckle device 60 disposed on concrete shell elements 61, 62. The turnbuckle device 60 consists of a first lock part 63 and a second lock part 64. The first lock part 63 is displaceably guided on a rod-shaped body 65 which has a shackle 66 in its end region. The shackle 66 has an opening 67 in its free end region into which a bolt 68 can be inserted which cannot rotate in its final position. The bolt 68 can engage through a further opening in the transverse strut 69 such that the first lock part 63 is held on the concrete shell element 62 via the rod-shaped body 65. When the second lock part 64 is pivoted as shown in FIG. 9, it can be moved in the region of the concrete shell element 62. The first lock part 63 can also be moved in the direction of the shackle 66 until the second lock part 64 can be pivoted into the inner position and be blocked by a wedge 70. If fixation is chosen to be provided by the bolt 68, archings on the stationary claws are not necessary. If the turnbuckle device 60 is to be removed from the transverse strut 69, the bolt 68 must be completely withdrawn from the opening 67. When the bolt 68 has been removed, the turnbuckle device 60 can be removed from the transverse strut 69. The function of the first and second lock parts 63 and 64 are not described in more detail in connection with FIG. 9 since they are formed like the above-described lock parts.

Figure 10:
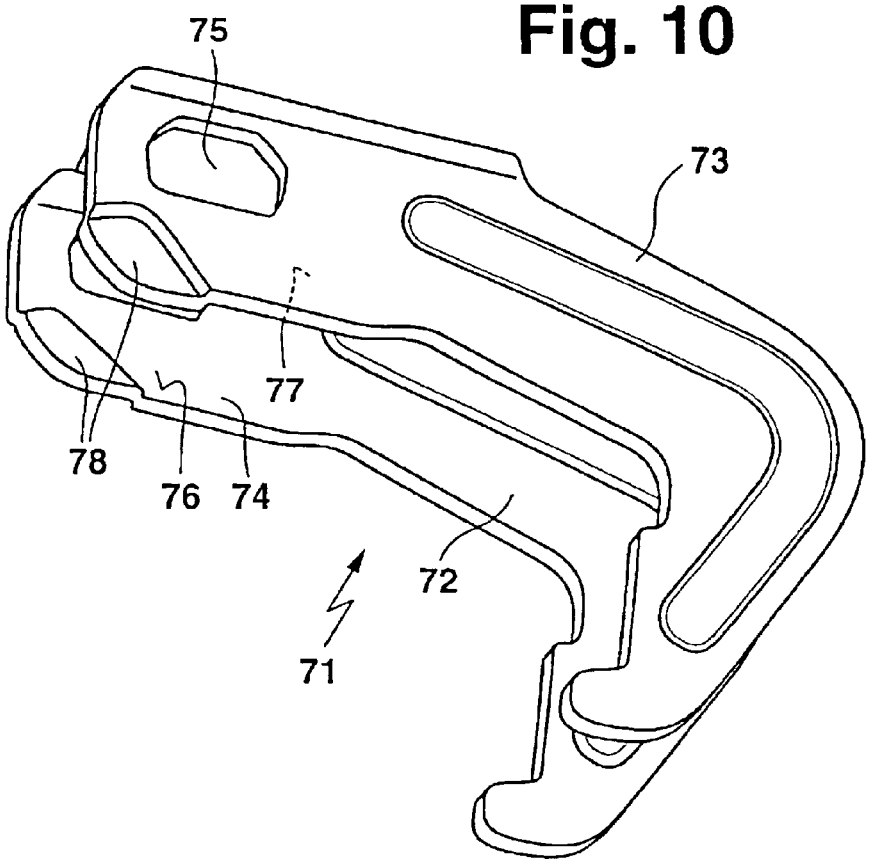
FIG. 10 shows an embodiment of a pivotable claw formed on an inventive turnbuckle device.

FIG. 10 shows a second lock part 71 which can be used as second lock part in a turnbuckle device 10 or in a turnbuckle device 60. Mutually spaced apart pivotable claws 72, 73 terminate in a common leg region 74 which connects the two claws 72, 73. The leg region 74 is provided with an opening 75 for a wedge (not shown in the figure). Projections 78 project over inner surfaces 76, 77 which can engage behind guiding strips on a first lock part such that the second lock part 71 can be moved and pivoted along a first lock part. The projections 78 act equally as the described projections 21.

Figure 11:
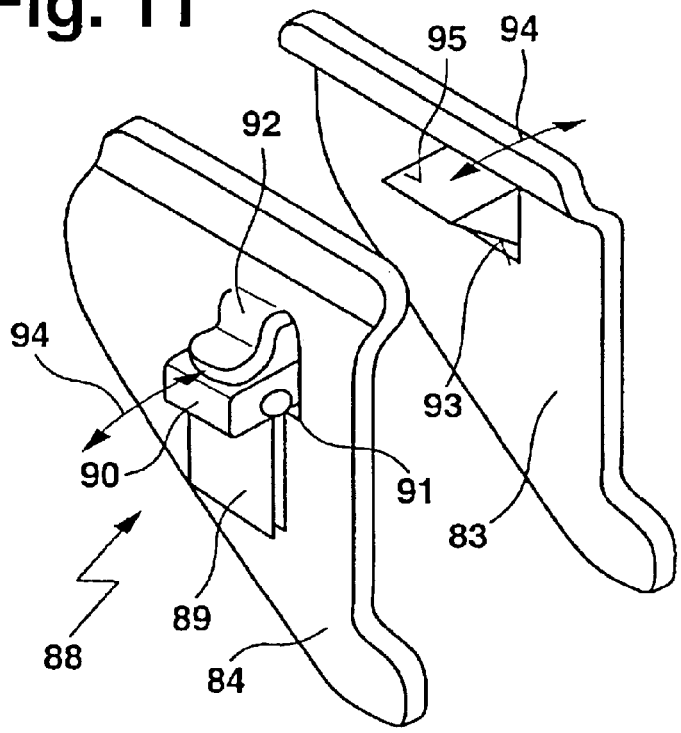
FIG. 11 shows an embodiment of stationary claws of an inventive turnbuckle device.

FIG. 11 shows an embodiment of the stationary claws 83, 84 which can be formed on an inventive turnbuckle device. The stationary claws 83, 84 are provided with one pivoting and/or tilting lever 88 each, which serves as a holding means and which is formed of a spring element 89 and a snap head or latch 90. The pivoting and/or tilting lever 88 is mounted to the outer sides of the stationary claws 83, 84 such that the snap head or the latch 90 can engage through an opening 91 of the stationary claws 83, 84. The stationary claws 83, 84 are provided with a guiding shackle 92 which serves as guiding surface for the snap head or latch 90 and prevents tilting of the snap head or latch 90 under load.

If an inventive turnbuckle device has stationary claws 83, 84 as shown in FIG. 11, it can be slid onto longitudinal or transverse struts of a concrete shell element in that the turnbuckle device is pressed onto the longitudinal or transverse strut via the snap head or latch 90 via an inclined surface 93 which is formed on the snap head or latch 90. When the inventive turnbuckle device is slid onto a longitudinal or transverse strut, the turnbuckle device has reached its final retaining position when the pivoting and/or tilting levers 88 engage behind recesses of the longitudinal or transverse strut. When the turnbuckle device is slid onto a longitudinal or transverse strut, the pivoting and/or tilting levers 88 move in the directions of arrow 94 by initially opening and subsequently tilting or pivoting back into their initial position in which they engage behind a surface of a longitudinal or transverse strut. If the inventive turnbuckle device is to be removed again from a longitudinal or transverse strut, at least one pivoting and/or tilting lever 88 must be withdrawn that far that it no longer engages behind the longitudinal or transverse strut. If at least one pivoting and/or tilting lever 88 no longer engages with the longitudinal or transverse strut, the turnbuckle device can be removed from a concrete shell element. When locked with a longitudinal or transverse strut, a surface 95 of the snap head or the latch 90 abuts a surface of the longitudinal or transverse strut which forms the arching or the undercut on the longitudinal or transverse strut. The spring element 89 of the pivoting and/or tilting lever 88 is formed as leaf spring in the embodiment of FIG. 11 such that the snap head or the latch 90 can be moved in the directions of arrow 94. FIG. 11 shows the initial position of the pivoting and/or tilting levers 88 into which the pivoting and/or tilting levers 88 self-actingly pivot.

What is claimed is:

1. A turnbuckle device for mutually clamping two concrete shell elements across a joint therebetween, the concrete shell elements each including a frame with longitudinal and transverse struts, said turnbuckle device comprising:

means for retaining said turnbuckle device on one of the longitudinal and transverse struts during separation of the shell elements, the retaining means comprising archings;

means for positioning said turnbuckle device across abutting edges of the concrete shell elements;

a first lock part including a stationary first claw for engaging one of the frames, the first claw being configured for direct engagement with the respective frame, said archings protruding from inner surfaces of the stationary claw;

a second lock part pivotally disposed with respect to said first lock part and including a second claw configured for direct engagement with another of the frames;

arresting means for limiting a pivoting range of said second lock part in order that the second claw prevents release of the turnbuckle device from the concrete shell elements and optimally limits movability of the turnbuckle device.

2. The turnbuckle device according to claim 1 wherein said arresting means are further operable for enabling the turnbuckle device to be removed from the concrete shell element.

3. The turnbuckle device according to claim 1 wherein the archings are offset from each other with a distance between the archings being larger than a width of the longitudinal or the transverse strut.

4. The turnbuckle device according to claim 1 wherein the archings are formed oppositely on an inner surface of the stationary claws.

5. A turnbuckle device for mutually clamping two concrete shell elements across a joint therebetween, the concrete shell elements each including a frame with longitudinal and transverse struts, said turnbuckle device comprising:

means for retaining said turnbuckle device on one of the longitudinal and transverse struts during separation of the shell elements, the retaining means comprising a shackle which projects from a rod-shaped body which holds and displaceably guides the first lock part, and the device further comprises a bolt mounting means for insertion into a first opening in the shackle;

means for positioning said turnbuckle device across abutting edges of the concrete shell elements;

a first lock part including a stationary first claw for engaging one of the frames, the first claw being configured for direct engagement with the respective frame;

a second lock part pivotally disposed with respect to said first lock part and including a second claw configured for direct engagement with another of the frames;

arresting means for limiting a pivoting range of said second lock part in order that the second claw prevents release of the turnbuckle device from the concrete shell elements and optimally limits movability of the turnbuckle device.

6. A turnbuckle device for mutually clamping two concrete shell elements across a joint therebetween, the concrete shell elements each including a frame with longitudinal and transverse struts, said turnbuckle device comprising:

means for retaining said turnbuckle device on one of the longitudinal and transverse struts during separation of the shell elements, the retaining means comprising a pivoting or tilting lever which is disposed on the stationary claw or in the region of the stationary claw;

means for positioning said turnbuckle device across abutting edges of the concrete shell elements;

a first lock part including a stationary first claw for engaging one of the frames, with the first claw being configured for direct engagement with the respective frame;

a second lock part pivotally disposed with respect to said first lock part and including a second claw configured for direct engagement with another of the frames;

arresting means for limiting a pivoting range of said second lock part in order that the second claw prevents release of the turnbuckle device from the concrete shell elements and optimally limits movability of the turnbuckle device.

7. The turnbuckle device according to claim 6 wherein the arresting means comprises a wedge which, when displaced in the direction of force of gravity, blocks the pivotable second claw in a pivoted inner position state and clamps the turnbuckle device for mutual clamping of two concrete shell elements, and when displaced against the force of gravity, releases the pivotable second claw for pivoting and displacement with respect to the first stationary claw.

* * * * *